US005209137A

United States Patent [19]

Yagi

[11] Patent Number: 5,209,137

[45] Date of Patent: May 11, 1993

[54] CONTROL APPARATUS FOR MARINE ENGINE

[75] Inventor: Mikiya Yagi, Takarazuka, Japan

[73] Assignee: Nippon Cable System Inc., Takarazuka, Japan

[21] Appl. No.: 808,402

[22] Filed: Dec. 16, 1991

[30] Foreign Application Priority Data

Dec. 17, 1990 [JP] Japan ..... 2-402884
Dec. 17, 1990 [JP] Japan ..... 2-402885

[51] Int. Cl.[5] ..... G05G 1/04

[52] U.S. Cl. ..... 74/511 R; 74/491; 74/501.6; 74/538; 29/425; 403/4

[58] Field of Search ..... 74/480 B, 491, 501.6, 74/511 R, 538; 29/425; 403/4; 192/0.098

[56] References Cited

U.S. PATENT DOCUMENTS 4,005,614 2/1977 Moore et al. ..... 74/511 X
4,137,799 2/1979 Olsen et al. ..... 192/0.098 X
5,094,123 3/1992 Latham ..... 74/480 B X

FOREIGN PATENT DOCUMENTS 2-173814 7/1990 Japan .

*Primary Examiner*—Allan D. Herrmann
*Attorney, Agent, or Firm*—Armstrong, Westerman, Hattori, McLeland & Naughton

[57] ABSTRACT

A control apparatus for a marine engine comprising an operating lever inserting into an opening from the back side to the fore side of hull board and disposed in the fore side of the hull board to control the marine engine by rotating a main body which is disposed in the back side of the hull board to transform a rotational movement of the operating lever into an operational force of a control cable and a set block installed on the fore side of the hull board to fix the main body to the hull board, the main body having a shaft which is connected with the operation lever to transmit movement of the operational lever and a plurality of first installation holes which are arranged radially, the set block having a slit for receiving the shaft in the lateral direction and a plurality of second installation holes arranged, along with a circle having the same diameter as a pitch circle of the first installation hole and part of which are located in the position accorded with the first installation holes when the shaft is received in the slit.

6 Claims, 9 Drawing Sheets

CONTROL APPARATUS FOR MARINE ENGINE

BACKGROUND OF THE INVENTION

The present invention relates to a control apparatus for marine engine, more particularly, to a single lever type apparatus for controlling an engine of a small boat, ship or vessel.

Single lever type control apparatus such as the type of control apparatus shown in FIGS. 8–11 are conventionally mounted by a user on a side board of the boat, ship or vessel.

Such apparatus 51 shown in FIG. 8 conventionally comprises a main body 52 installed in the back side of the hull board A, a set block 53, having a half-cylindrical-shaped neutral block 56, installed in the front, or cabin side, a cover 54 and an operating lever 55.

The main body 52 is connected with the set block 53 by means of an installing member 52*a* through an opening of the hull board A. The main body 52 is connected with the operating lever 55 by means of a shaft 52*b* projected from the center of member 52*a* in such a manner that the shaft 52*b* penetrates the set block 53 through a hole 53*a* therein.

The hull board A is provided with set block 53 fixed to hull board A bolts and the like.

Set block 53 is provided with cover 54 in such a manner that the operating lever side face is covered with the cover 54.

Another apparatus of the conventional type employs the set block 61 shown in FIG. 9. The set block 61 has a plurality of installing holes 62 arranged radially. The main body 52 is connected with the set block 61 in such a manner as to be rotated relative to set block 61.

Another conventional arrangement is shown in FIG. 10, wherein the main body 71 is integratedly combined with the set block 72. The main body 71 and the set block 72 are arranged in the back side of the hull board B by means of the installing bolt and the like which inserts into a bolt hole from the front side of the hull board B. The shaft 74, projected from the main body 71, is connected with the operating lever 75 on the front side through the opening of the hull board B. Set block 72 is provided with a cover 76, having two parts in such a manner that the shaft is sandwiched between such two parts by means of a projection 77 for installing the cover 76 from the front side of the hull board B.

Another conventional apparatus 81, as shown in FIG. 11 comprises a main body 82 arranged in the back side of the hull board A, set block 83 arranged in the front or operator side of the hull board A, the cover 84 and the operating lever 85.

The main body 82 is connected with the set block 83 by means of the installing member 82*a* of the main body 82 through the opening of the hull board A. The main body 82 is connected with the operating lever 53 by means of a shaft 82*b* which is projected from the center of the installing member 82*a* in such a manner the shaft 82*b* penetrates the set block 83 through the hole 83*a*.

The set block 83 is formed into a half-cylindrical-shaped neutral block 86 integratedly in half of peripheral zone of the hole 3*a*.

In the middle of outer peripheral zone, the neutral block 86 is formed into an approximately rectangular recessed portion 87 for locking the operating lever 85 by virtue of engaging with the operating lever 85.

The hull board A is provided with the apparatus by virtue of installing eh set block 83 on the hull board A by means of installing bolts.

Set block 83 is provided with cover 84 in such a manner that the operating lever 85 side face of block 83 is covered with the cover 84.

The main body 52, in the conventional embodiment of FIG. 8 and the set block 53 are installed in such a manner that the hull board A is sandwiched between the main body 52 and the set block 53. The shaft 52*b*, which is projected on the hull board in the fore side, must be connected with the operating lever 55 after the shaft 52*b* of the main body 52 is inserted into the opening the hull board A and the shaft 52*b* inserts into the set block 52. Accordingly, the apparatus 51 of the conventional embodiment of the FIG. 8 cannot be installed on the hull board B in such a state that the main body 52 is integratedly combined with the operating lever 55.

It is very troublesome to install the apparatus 51 on the hull board A because connecting the main body 52 with the operating lever 55 is performed, together with a job such as installing a warm-up button, after the hull board A is provided with the main body 52.

The apparatus 51 cannot be installed in such a state that the main body 52 can be rotated relative to the set block 53, in other words, in such a state that the main body 52 can be rotated relative to the hull board A. Accordingly, an installation position is limited. That is to say, the installation position of the main body 52 cannot be changed even if the installation position is desired to change under such a circumstance as a space for the main body in the back side of the hull board A, a space for arranging a control cable. Thus, in installation, the apparatus 51 has a low degree of freedom.

In the conventional type apparatus with set block 61, FIG. 9, set block 61 is radially arranged around the periphery of the hole 53A. Thus, the main body 52 can be installed in such a manner that the main body 52 is rotated relative to the set block 61. However, such apparatus cannot be installed after the main body 52 is once combined with the operation lever 55 integratedly.

In the conventional apparatus with operating lever 75 because operating lever 75 can be passed through the opening of the hull board B, such conventional apparatus can be installed after the main body 71 is combined with the operating lever 75. However, the main body 71 cannot be attached to hull board B in such a manner that the main body 71 is rotated relative to the hull board B.

In the conventional apparatus 81, the main body 82 can be connected with the set block 83 in such a manner that the main body 82 is rotated relative to the hull board A. In order to change the installation position by rotating the main body 82, it is necessary to rotate the main body 82, together with the set block 83 and then fix the main body 82 on the hull board A after the hull board is newly formed with holes for bolting. It is impossible or very troublesome to so fix the main body 82 on hull board A. Even if the installation position of the main body is changed, a neutral position of the operating lever 85 is also limited to the rotated position because the neutral block 86 is integratedly combined with the set block 83. Accordingly, the operating lever 85 is located in such a position as not to be changed.

An object of the present invention is to resolve the above-mentioned disadvantages and to provide such a control apparatus that the apparatus can be installed on the hull board after the main body is integratedly combined with the operating lever, the installation position can be easily regulated by rotating the main body, and the neutral position of the operating lever can be selected at will.

SUMMARY OF THE INVENTION

According to the present invention, there is provided a control apparatus for marine engine comprising an operating lever inserting into an opening from the back side to the fore side of a hull board and disposed in the fore side of the hull board to control the marine engine by rotating, a main body which is disposed in the back side of the hull board to transform a rotational movement of the operating lever into an operational force of a control cable and a set block installed on the fore side of the hull board to fix the main body to the hull board, the main body having a shaft which is connected with the operational lever to transmit a movement of the operational lever and plurality of first installation holes which are arranged radially, the set block having a slit for receiving the shaft in the lateral direction and plurality of second installation holes arranged in a circle having the same diameter as a pitch circle of the first installation hole and part of which are located in the position accorded with the first installation holes on the condition that the shaft is received in the slit.

It is preferable that pitch circles of the first and second installation holes are respectively concentric when the main body is connected with the block.

It is preferable to have a cover which form into a slit for receiving the shaft laterally and which is abutted to the set block in such a manner as to hide the slit in the state that the shaft is received in the slit.

It is preferable that the control apparatus has a neutral block disposed around the shaft which is connected with the operating lever located in the position where the shaft is rotated relative to the operational lever to lock the operational lever in the neutral position, relative installation positions of the main body to the neutral block being able to be changed.

It is preferable that the neutral block comprises a cylinder portion having a hollow portion for insertion of the shaft, a flange for fixing which is formed in a lower side of the cylinder portion and a marginal edge for establishing the neutral position which is formed in an upper side of the cylinder portion, part of outer periphery of the flange is formed in to substantially rectangular shaped recessed portion, and the flange and the set block are, respectively, formed in to plurality of first installation holes and plurality of second installation holes on the pitch circle having the same diameter.

The apparatus, in accordance with the invention, can be easily installed on the hull board by users since the main body can be connected with the operating lever together with a cable connection before the apparatus is installed on the hull board.

Moreover, when the apparatus is installed on the hull board, or after the apparatus is installed, the installation position of the main body can be changed by virtue of rotating the main body. Accordingly, the users can select the installation position of the main body in such a manner that the main body is rotated and can easily cope with such a problem that the installation position should be changed by a reason which appears after installation of the apparatus.

DETAILED DESCRIPTION

Figure 1:
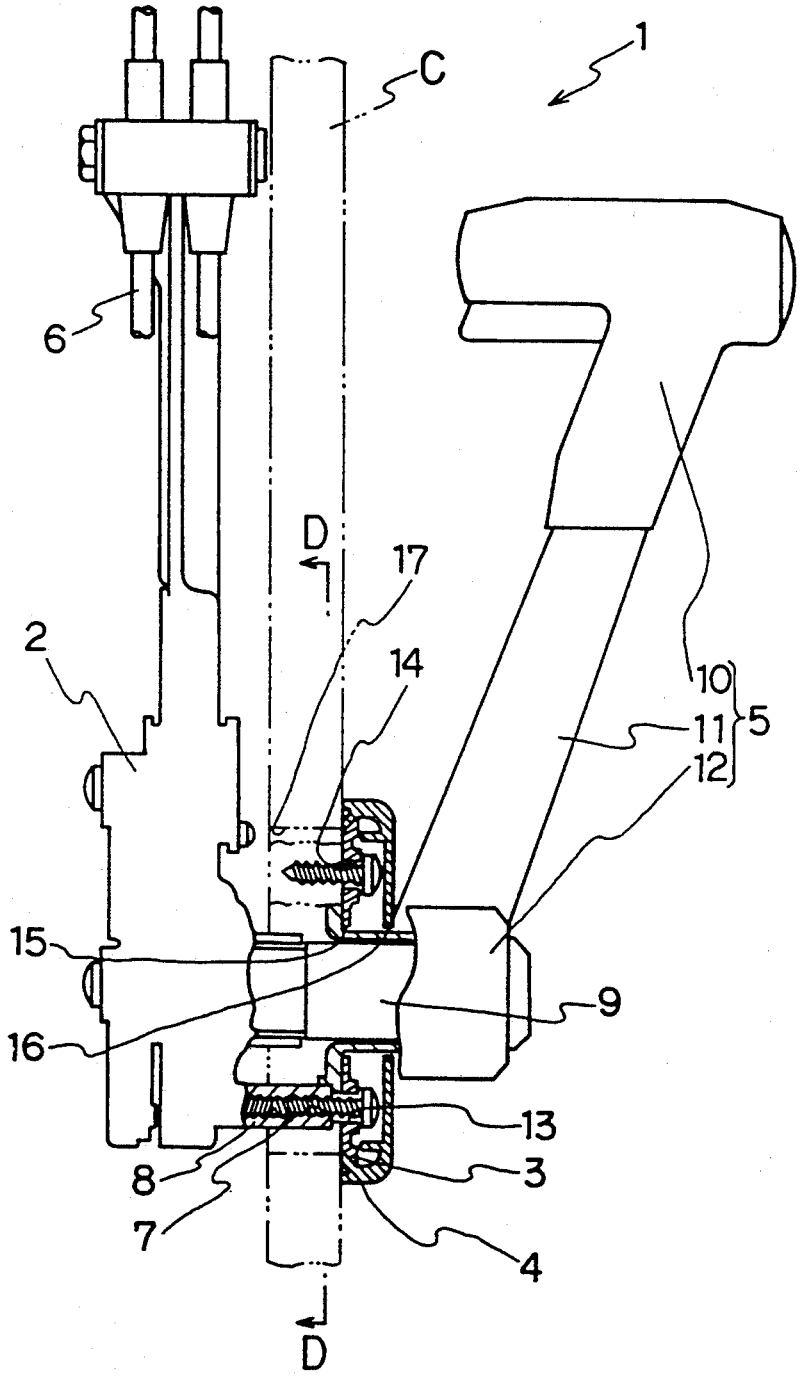
FIG. 1 is a partially cutaway front view showing one embodiment of the present invention.

In FIG. 1 numeral 1 denotes an apparatus which comprises a main body 2, a set block 3, a cover 4 and an operating lever 5.

The main body 2 has a mechanism (not shown in Figures) for transforming an operating force of the operating lever by an operator into the operating force of a control cable for controlling a marine engine.

Plurality of projections 8, each of which has a tapped hole for fixedly connecting the main body 2 with the set block 3, are formed in such a manner as to be radially arranged in the main body 2. The main body 2 is arranged on a hull board C in the back side thereof.

The main body 2 is provided with a shaft 9 which can be rotated. The above-mentioned operating force transforming mechanism, contained in the main body 2, is connected with one end of the shaft 9. The other end of the shaft protrudes outside of the main body 2 from the central portion at a pitch circle of projection 8. Then, the shaft 9 can be connected with the operating lever 5.

The operating lever 5, comprising 10 a handle portion 10 an arm portion 11 and a base portion 12, is connected with the shaft 9 of the main body 2.

Figure 7:
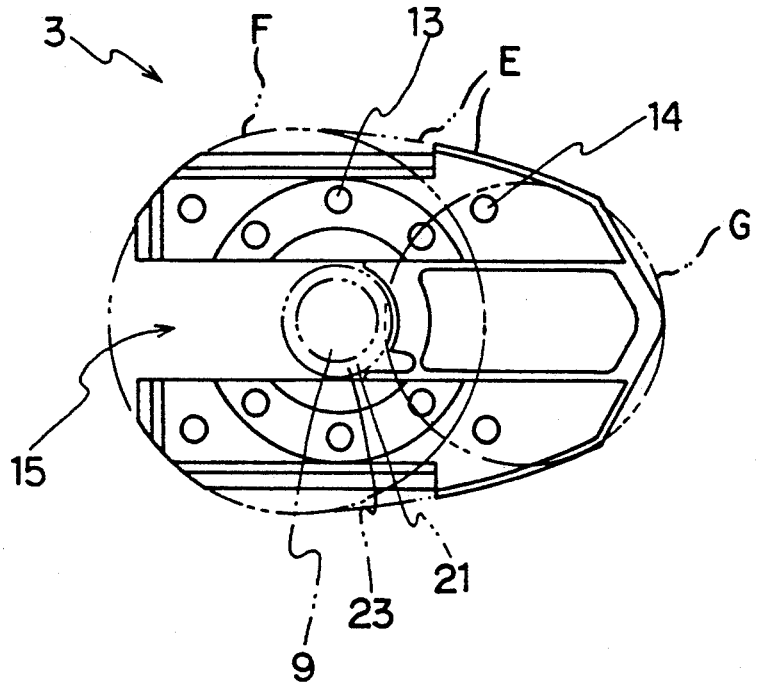
FIG. 7 is an illustrative view showing a positional relationship between the set block and the neutral block.
Figure 8:
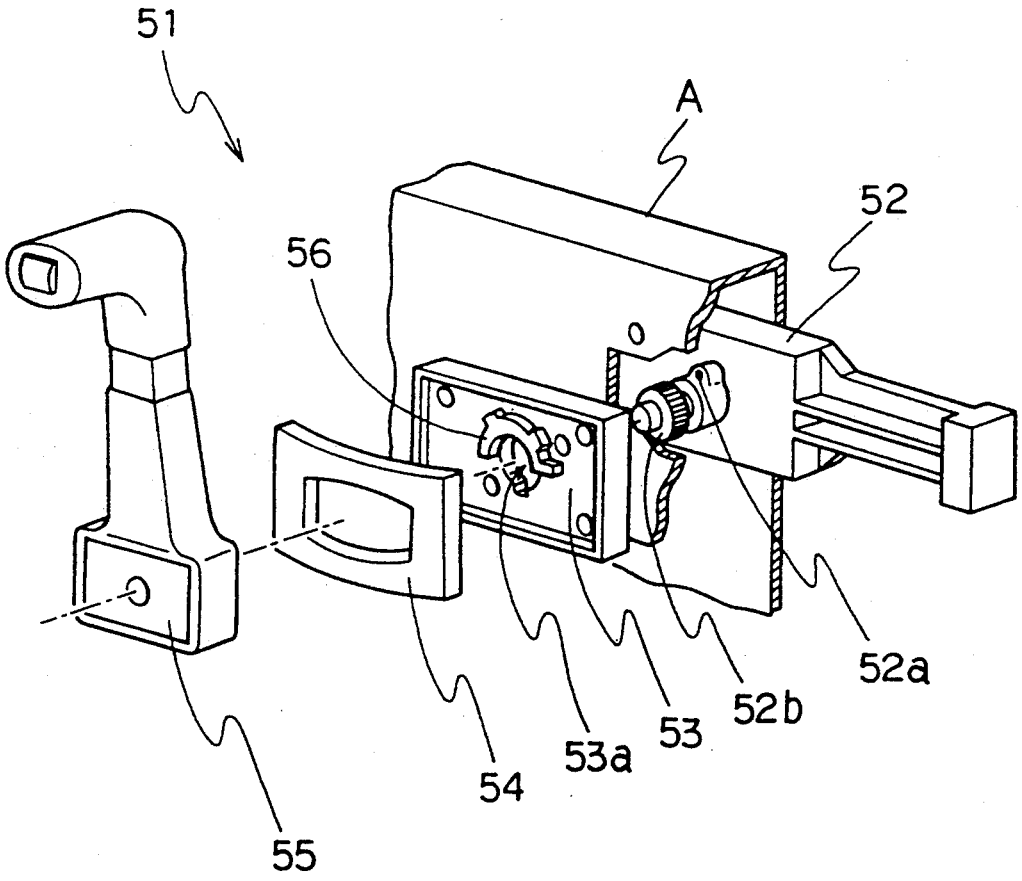
FIG. 8 PRIOR ART
FIG. 8 a perspective view showing a conventional apparatus.
Figure 9:
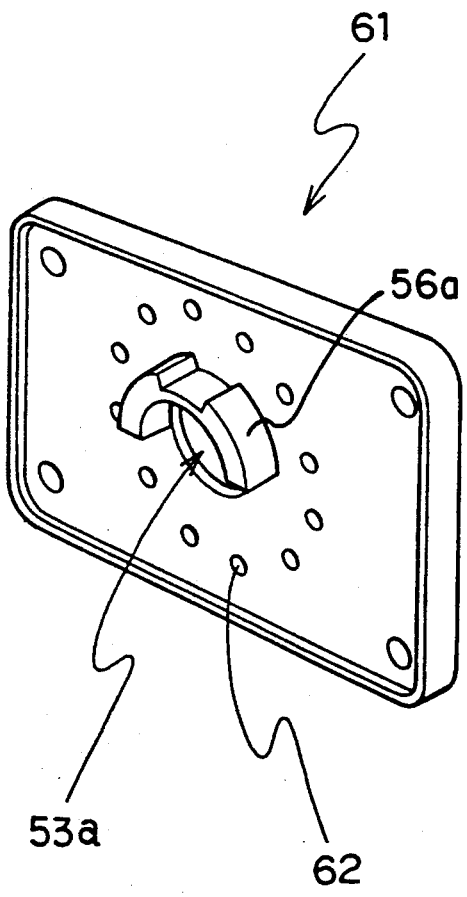
FIG. 9 PRIOR ART
FIG. 9 is a perspective view showing a set block in the conventional apparatus of FIG. 8.
Figure 10:
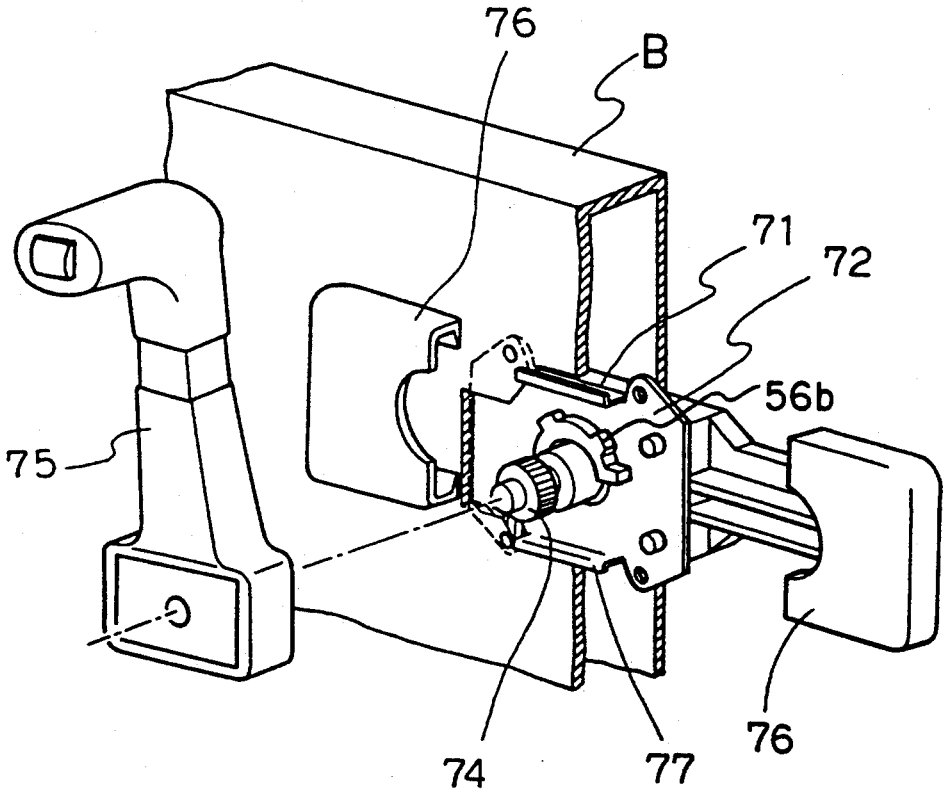
FIG. 10 PRIOR ART
FIG. 10 is a perspective view showing another conventional apparatus.
Figure 11:
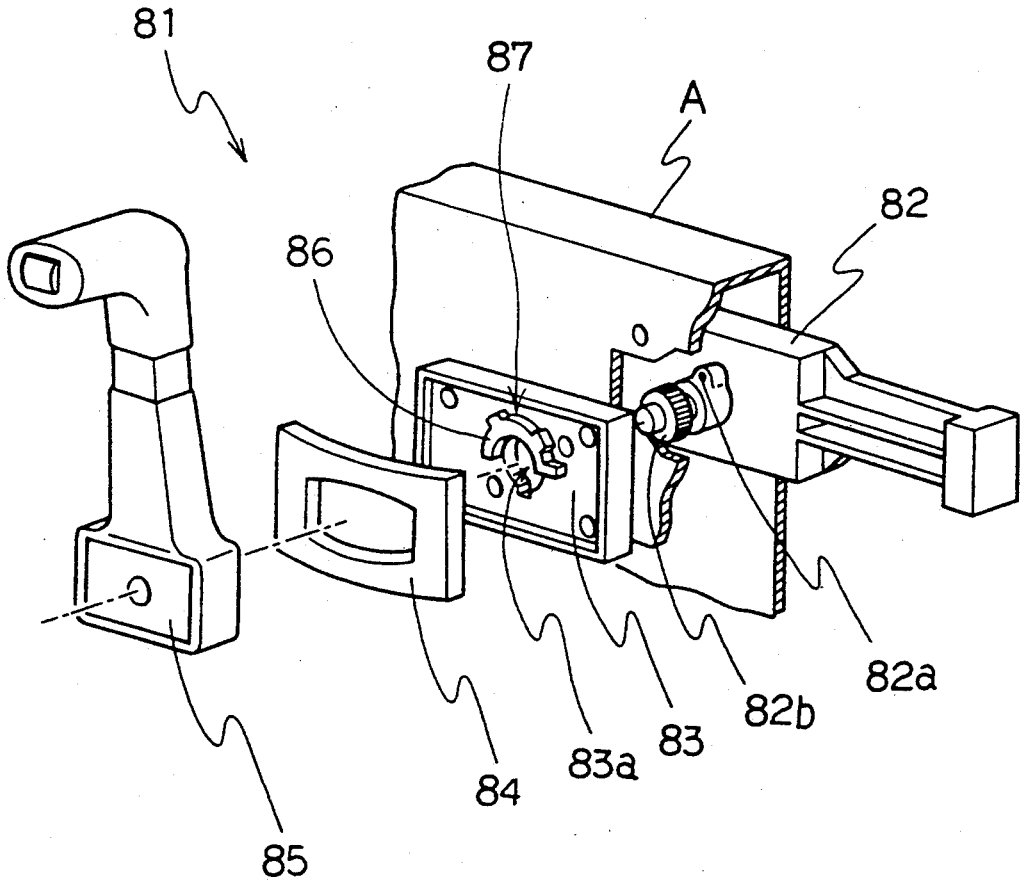
FIG. 11 PRIOR ART
FIG. 11 is a perspective view showing still another conventional apparatus.

The set block 3, FIG. 7, what is called a deformed elliptic shape E periphery of which envelopes a large circle F and a small circle G ashown in FIG. 7.

A plurality of installation holes 13 are formed in the set block 3 in such a manner as to be concentrically arranged with a circle having the same diameter as the pitch circle, FIG. 7, of the tapped holes 7 of the main body 2. Besides, holes 14 for fixing the set block 3 by means of bolts, and the like, to the hull board C are also formed in the set block 3.

A first slit 15 is formed in such a manner that the set block 3 is cut away from a marginal edge of the large circle to the center of the large circle. Then, the set block can be laterally received along with the line extending from the center of the large circle and the small circle.

The cover 4 has the same outer shape as the set block 3.

Contrary to the set block 3, a second slit 16 is formed in the cover 4 in such a manner that the cover 4 is cut away from the side of the small circle to the center of the small circle. The set block 3 is provided with the cover 4 by abutting the cover 4 thereto in such a manner that the shaft 9 can be received in the second slit 16. Accordingly, a part of the hull board C, exposed from the first slit 15 of the set block 3, can be covered with a portion having a large diameter of the cover 4. Assembling of each element of the apparatus as constructed hereinbefore, and installed to the hull board C are explained.

Because the base portion of the operating lever 5 is inserted over the shaft 9 of the main body 2 and the shaft 9 is fixed to the operating lever 5.

After integratedly combining the main body 2 with the operating lever 5, the operating lever 5 is projected from the back side to the fore side of the hull board C through an opening 17 which is formed in the hull board C. Then, the main body 2 is abutted to the fore side of the hull C and the tapped holes 7 are exposed to the fore side of the hull board C through the opening. Next, the set block 3 is arranged in such a manner that the first slit 15 of the set block 3 accommodates shaft 9.

Figure 3:
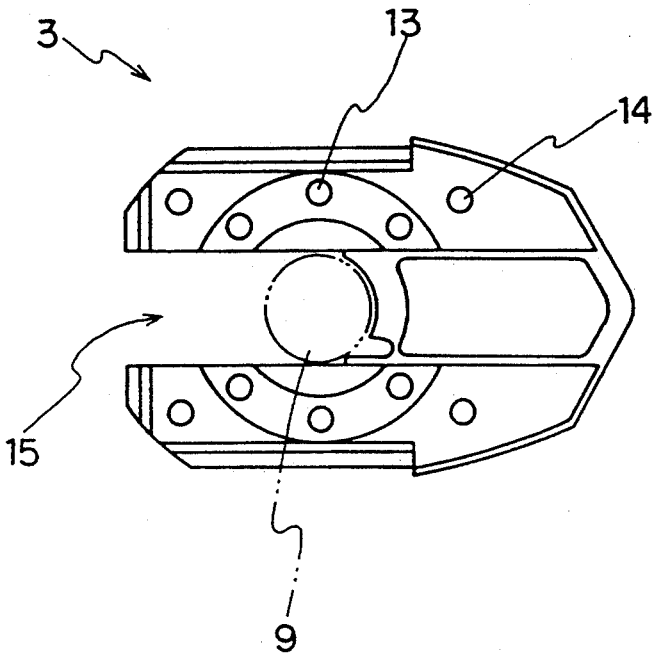
FIG. 3 is a plan view showing a set block in the apparatus of FIG. 1.
Figure 4:
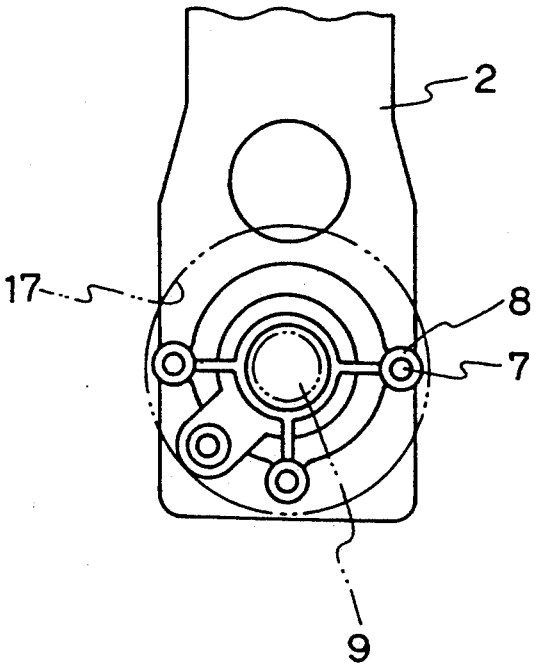
FIG. 4 is a side viewed from the direction of arrow D of a principal part of the apparatus of FIG. 1.

In the state, the tapped holes 7 of the main body 2 partially accords with the installation holes 13 of the set block 3, referring to FIGS. 3 and 4, because the pitch circle of the tapped holes 7 and the installation holes 13 are the same. Accordingly, the main body 2 can be fixedly combined with the set block 3 in such a manner that bolts and the like are screwed into the tapped holes 7 through the installation holes 13. The tapped holes 7 are made to coincide with the installation holes 13 when the main body 2 rotates through prescribed angle. Thus, the installation position of the main body can be changed by rotating the main body 2 through prescribed angles. Moreover, the apparatus 1 can be installed on the hull board C by fixing the apparatus to the hull board C in such a manner that wood screws, and the like, are screwed into the hull board C through the hoes 14 for fixing the apparatus to the hull.

Figure 5:
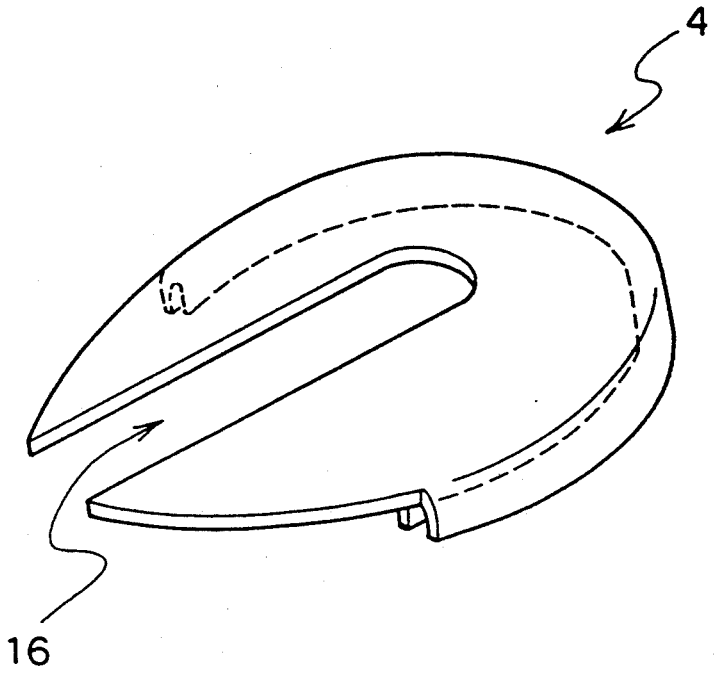
FIG. 5 is a perspective view showing a cover in the apparatus of FIG. 1.

With respect to the first embodiment, both the set block 3 and the cover 4, FIGS. 3, 5 and 7 have deformed elliptic shape E. However, in accordance with the present invention the shape of the set block 3 and the cover 4 is not limited to such a shape.

For instance,, a circular shape or a rectangular shape can also be employed. However, it is preferable that the set block 3 has almost the same shape as the cover 4 because of the state that the set block 3 is provided with the cover. In the embodiment, the first slit 15 is formed along with the line extending from the center of the large circle F to the center of the small circle G, FIG. 7, on such a manner that the set block 3 is cut away from the marginal edge of the large circle to the center of the large circle.

The second slit 16, FIG. 5, is formed along with the above-mentioned line in such a manner that the cover 4 is cut away from the marginal edge of the small circle to the center of the large circle. However, in accordance with the present invention, each of the first slit 15 and the second slit 16 can be formed in such a manner that the set block 3 and the cover A can be, respectively, cut away from the marginal edge of either the large circle of the small circle.

When the cover 4 is abutted to the set block 3, the shaft is received in the first slit 15 and the second slit 16, and it is enough that the arrangement of the installation holes of the set block is concentric with the shaft. However, is preferable that the first slit 15 is not concentric with the second slit 16 so that the hull board is not exposed from the first slit 15 or the second slit 16.

In accordance with this embodiment, though the number of the tapped holes 7 is three and the number of the installation holes 13 is six, as shown in FIGS. 3 to 4, the number of the tapped holes and the installation holes are not limited.

According to the present invention, it is very easy to install the apparatus because the apparatus can be installed on the hull board after the main board is integratedly connected wit the operating lever together with connecting cable. Furthermore, there is such an advantage as to select and adjust the installation position of the main body at will.

Figure 2:
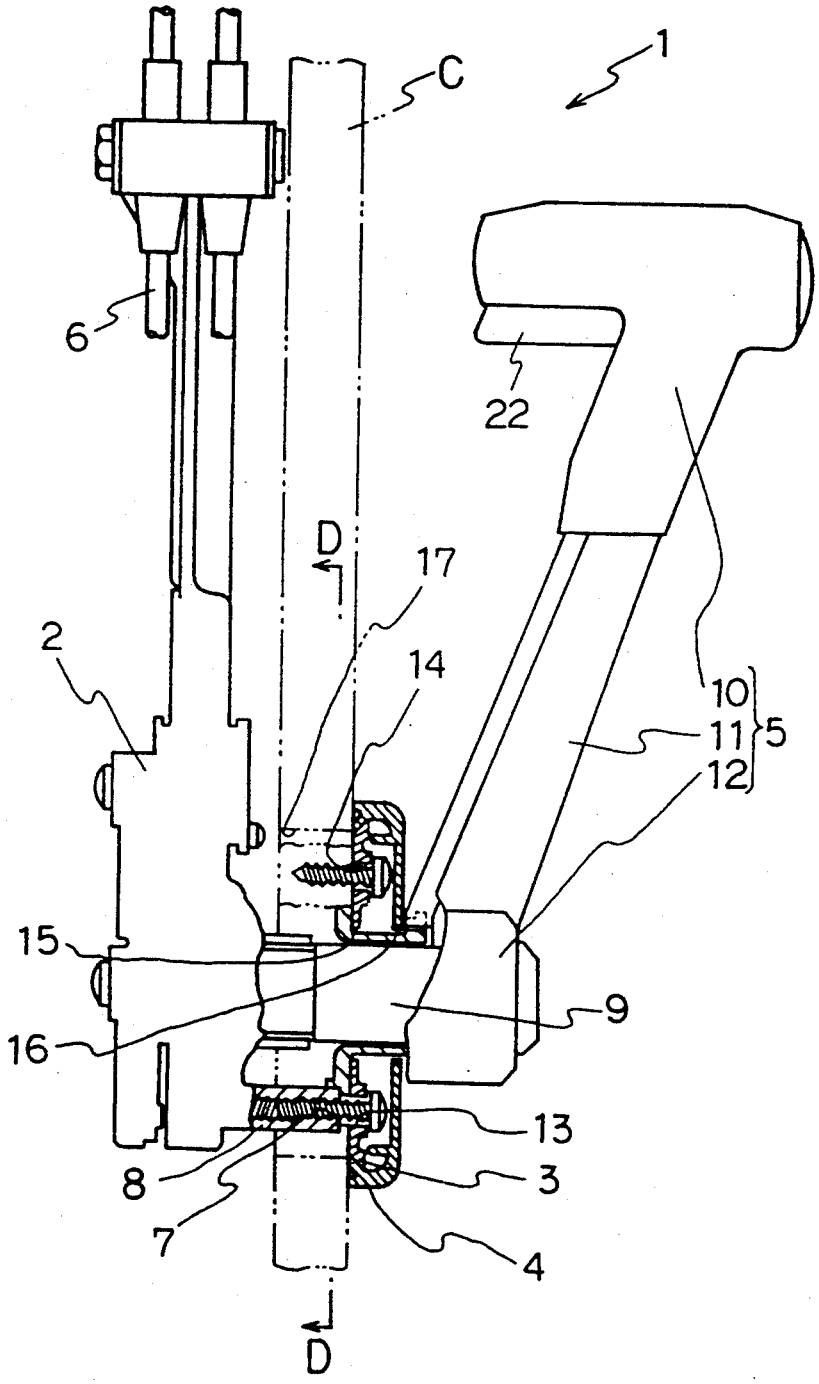
FIG. 2 is a partially cutaway front view showing another embodiment of the present invention.
Figure 6:
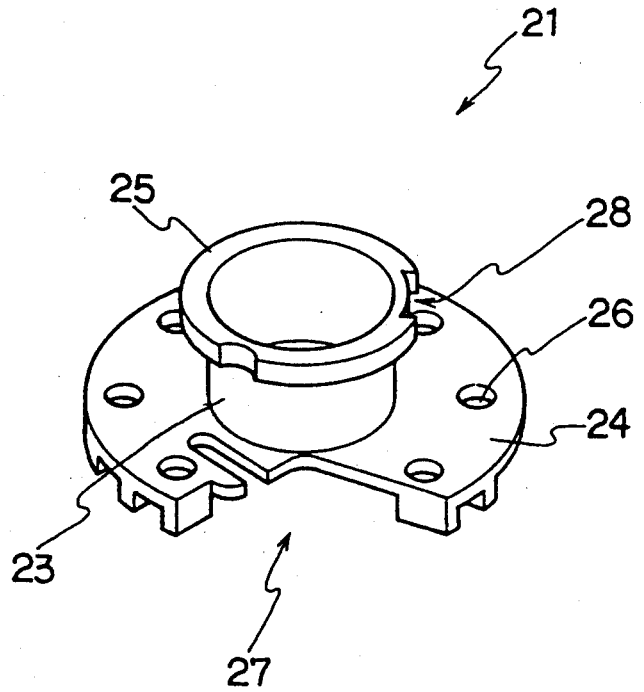
FIG. 6 is a perspective view showing a neutral block i the apparatus of FIG. 1.

Next, another embodiment of the present invention is explained referring to FIGS. 2 and 6. The operating lever 5 of the apparatus is provided with a trigger 22 so that the operating lever 5 is locked in the neutral position.

The trigger 22 extends from the handle portion 10 to the base portion 12 along with the arm portion 11 and the trigger 22 is biased in the side of the base portion 12.

The neutral block 21 is an element for locking the operating lever 5 in the neutral position by virtue of connecting with the trigger 22. The neutral block 21 comprises a cylindrical portion 23, referring to FIG. 6, a flange 24, formed in the lower side of the cylindrical portion 23, for fixing to the hull board and a brim 25 which is formed in the upper side of the cylindrical portion 23 for establishing the neutral position. In the flange 24, plurality of holes 26 for bolting are formed. A "fan-like-shaped" slit 19 of which the central angle is 90 degrees is radially formed the peripheral edge to the center of the flange 24. The slit 19 is formed so that the bolts for installing the set block 3 can be penetrated.

Accordingly, the slit 19 is limited to the fan-like-shape if the bolts, and the like, can be penetrated. A circular shape can be also employed.

The brim 25 has such a diameter as to be slightly larger than that of the cylindrical portion 23 and smaller than that of the flange 24. A rectangular shaped recessed portion 28 is formed in the outer periphery of the brim 25. The recessed portion 28 is arranged so that a tip of the trigger 22 can be received. The recessed portion 28 is arranged in such a manner as to correspond with the neutral position of the operating lever 5.

Since the trigger 22 is biased in the side of the base portion 12 of the operating lever 5, as mentioned hereinbefore, the tip of the trigger 22 is received in the recessed portion 28 and a rotation movement of the operating lever 5 is locked with the position of the recessed position accorded with the tip of the trigger 22.

When the trigger 22 is pulled up in such a manner as to grip the handle portion 10 of the operating lever 5, the locked state of the operating lever 5 is removed.

The set block 3 has such a deformed elliptic plate like shape E that the outer periphery hereof envelopes the large circle F and the small circle as shown in FIG. 7. A plurality of installation holes 13 are formed along a circle concentric with the large circle. The tapped holes 8 of the main body 2 have a pitch circle of the same diameter as the holes 26 for bolting of the neutral block 21. The pitch of holes 26 for bolting and the installation holes 13 are half times as much as holes 8. Accordingly, even if the set block is relatively rotated through prescribed pitch from the position where the holes for bolting, the installation holes 13 and the tapped holes 8 are concentric, the holes 26 for bolting, the installation holes 13 and the tapped holes 8 are intended to be again concentric (referring to FIGS. 3 and 5). Further, penetrated holes 14, for connecting the set block 3 with the hull board C, are formed in the set block 3.

The first slit 15, having a width which is a little longer than an outer diameter of the cylindrical portion, is formed along wit the line extending from the center of the large circle to the center of the small circle in such a manner that the set block 3 is cut away from the marginal edge of the large circle to the center of the large circle. The first slit 15 has such a half circular shape in the bottom portion 29 thereof as to the aligned with an outer periphery of the cylindrical portion 23. With respect to this embodiment, it is almost the same as the embodiment mentioned hereinbefore except for the trigger 22 and the neutral block 21.

According to the embodiment, each of the elements is installed on the hull board C as mentioned hereinafter.

Firstly, the neutral block 21 is inserted on the shaft 9 of the main body 2 from the side of the flange 24.

Next, the main body 2 is rotatably connected with the operating lever 5 by fixing the shaft 9 to the base portion 12 of the operating lever 5.

The integratedly assembled apparatus, as mentioned hereinbefore, is in such a state that the operating lever 5 and the shaft 9 connected with the neutral block 21 are let to dispose from the side of the hull board C to the fore side of the hull board C through the opening 17. This can be accomplished, as stated above, by inserting the main body 2 into the opening 17 from the fore side to the back side of the hull board C in accordance with the space of the back side of the hull board C.

In keeping up the above state, the set block 3 is installed in such a manner that the cylindrical portion 23 of the neutral block is laterally received in the first slit 15 from the fore side of the hull board C to the bottom portion 29 of the first slit 15. Next, the tapped holes 8, the holes 26 for bolting and the installation hole 13 are accorded as mentioned hereinbefore. Then the main body 2 is integratedly combined with the neutral block 21 and the set block 3 at the same time. Each of the main body 2, the operating lever 5 can be installed in such a state as to be able to lock the neutral position thereof at will, not only by fixing the main body 2 in the desired neutral position after rotating the main body 2, but also by coinciding the position of operating lever 5 with the recessed portion 28 of the neutral position after rotating the neutral block 21, after the operating lever 5 is removed from the shaft 9.

In other words, the installation position of the main body 2 can be changed a occasion demands after establishing the neutral position of the operating lever 5 vertically as generally desired.

In accordance with the above apparatus, the neutral position can be selected, at will, by rotating the main body.

Though several embodiments of the invention are described above, it is to be understood that the present invention is not limited to the above-mentioned embodiments, and various changes and modifications may be made in the invention without departing from the spirit and scope thereof.

What is claimed is:

1. A control apparatus for a marine engine for mounting on a hull board having an opening extending from a back side to a fore side, comprising:

an operating lever rotatably mounted through the opening in the hull board, said operating lever being disposed for rotation on the fore side of the hull board for controlling the marine engine:

a main body disposed on the back side of the hull board for transforming rotational movement of said operating lever into operation force on a control cable, said main body having a shaft connected with said operating lever for transmitting movement of said operating lever and a plurality of first installation holes arranged in a first pitch circle radially about said shaft; and a set block installed on the fore side of the hull board for fixing said main body to the hull board, said set block having a slit for receiving said shaft in the lateral direction during installation and a plurality of second installation holes arranged in a second pitch circle having the same diameter as the first pitch circle of said first installation holes with at least some of said second installation holes aligned with said first installation holes when said shaft is received in said slit.

2. The apparatus of claim 1, wherein said pitch circles of said first and second installation holes are respectively concentric when said main body is connected with said set block.

3. The apparatus of claim 1, including a neutral block that is attached to the hull board when installed and a locking device for releasably connecting said operating lever at a neutral position, said neutral block being disposed around said shaft, said neutral block and said main body being configured for allowing for different installation positions of said neutral body relative to said main body.

4. The apparatus according to claim 3, wherein said neutral block comprises a cylinder portion having a hollow portion for insertion of a shaft, a flange formed on a lower side of said cylindrical portion for mounting said neutral block to the hull block, and a marginal ledge formed on an upper side of said cylindrical portion, said marginal edge being formed with a substantially rectangular shaped recessed portion, and said flange and said set block are respectively formed with a plurality of said first installation holes on said first and second pitch circles having the same diameter.

5. The apparatus of claim 1 or 4, including a cover provided with a slit for receiving said shaft laterally during installation, said cover abuts to said set block in such a manner as to hide said slit in said set block when said shaft is received in said slit in said cover.

6. The apparatus of claim 4, wherein said first and second pitch circles are concentric with said shaft of said main body.

* * * * *